US007270440B2

(12) United States Patent
Levy et al.

(10) Patent No.: US 7,270,440 B2
(45) Date of Patent: Sep. 18, 2007

(54) MAKE-UP APPLICATOR WITH LED LIGHT SOURCE

(76) Inventors: Brad Levy, 398 E. Rayon Ave., Youngstown, OH (US) 44505; Robert Dugrenier, R.R. #1 Box 2909, Townshed, VT (US) 05353

( * ) Notice: Subject to any disclaimer, the term of this patent is extended or adjusted under 35 U.S.C. 154(b) by 0 days.

(21) Appl. No.: 10/512,502

(22) PCT Filed: Apr. 28, 2003

(86) PCT No.: PCT/US03/12957

§ 371 (c)(1),
(2), (4) Date: Apr. 15, 2005

(87) PCT Pub. No.: WO03/090692

PCT Pub. Date: Nov. 6, 2003

(65) Prior Publication Data

US 2006/0146557 A1 Jul. 6, 2006

Related U.S. Application Data

(60) Provisional application No. 60/375,982, filed on Apr. 26, 2002.

(51) Int. Cl.
*F21V 33/00* (2006.01)

(52) U.S. Cl. ..... 362/136; 362/109; 362/119; 362/253; 206/385

(58) Field of Classification Search ..... 362/136, 362/253, 109, 119, 118; 206/385; 401/195
See application file for complete search history.

(56) References Cited

U.S. PATENT DOCUMENTS

| | | | | |
|---|---|---|---|---|
| 3,706,354 | A | 12/1972 | Gruska | |
| 4,407,311 | A * | 10/1983 | Gueret | 401/122 |
| 4,452,262 | A | 6/1984 | Jankewitz | |
| 4,888,667 | A | 12/1989 | Hwang | |
| D365,176 | S * | 12/1995 | Heinrich | D28/87 |
| 5,715,848 | A | 2/1998 | Conley, Jr. | |
| 5,945,111 | A | 8/1999 | Essër | |
| 6,027,272 | A * | 2/2000 | Spencer et al. | 401/158 |
| 6,991,345 | B2 | 1/2006 | Helenowski | |
| 2002/0054783 | A1 * | 5/2002 | Gueret | 401/202 |
| 2002/0067947 | A1 * | 6/2002 | Liu | 401/66 |
| 2002/0098216 | A1 * | 7/2002 | Nadel | 424/401 |
| 2005/0135088 | A1 * | 6/2005 | Helenowski | 362/136 |

* cited by examiner

*Primary Examiner*—Stephen F. Husar
*Assistant Examiner*—Meghan K. Dunwiddie
(74) *Attorney, Agent, or Firm*—Standley Law Group LLP

(57) ABSTRACT

A device is provided to apply make-up (10) in low-light situations. The device has a body tube (14), with a first and a second and a intermediate portion therebetween. The first end has a radial cross-section with an inner portion and an annular outer portion. Mounted in the inner portion of the first end is a make-up (10) applying means (16). Surrounding the make-up applying means (16) is an illuminating means (22) for illuminating, positioned in the annular outer portion of the first end. It is adapted to project the illumination axially outwardly. The illuminating means (22) is power by a powering means (24) is activated by a switch (621). In some embodiments, a second make-up applying means (16) is mounted in the second end.

19 Claims, 6 Drawing Sheets

MAKE-UP APPLICATOR WITH LED LIGHT SOURCE

This application claims priority from provisional application Ser. No. 60/375,982, filed on 26 Apr. 2002.

The present invention relates to a make-up applicator provided with a light-emitting diode ("LED") light source.

BACKGROUND OF THE ART

Proper application of lipstick and other make-up requires a certain amount of visual input, so it is generally done in front of a mirror. In a low-light situation, additional lighting is sometimes required. Such additional lighting should be directed to the point of application.

A make-up applicator with a lighting source is an ideal solution to this problem. The prior art is replete with attempts to provide an effective solution, but apparently the attempts have been ineffective, as commercial products incorporating these concepts are simply not available.

One piece of prior art, U.S. Pat. No. 4,888,667 to Hwang (Dec. 19, 1989) teaches a lipstick cap with lamp devices, including a cap sleeve used to receive a common lipstick sleeve and a rotary switch engaged with the cap sleeve, wherein the cap sleeve is equipped with several lamp devices and a pair of conducting plates that electrically connect the lamp devices in series. The rotary switch has a battery container including an anode and a cathode conducting plate that can be selectively electrically connected with the conducting plates of the lipstick cap by rotating the rotary switch. When a battery is contained in the battery container, the lamp devices can be lighted for illuminating the make-up applicator.

It is therefore an object of the present invention to provide an effectively lighted make-up applicator for use in low-light situations.

SUMMARY OF THE INVENTION

This and other objects of the invention are provided by an applicator for make-up that is useful in low-light situations. Such an applicator comprises a body tube, a first make-up applying means, a first illuminating means, a means for powering the first illuminating means and a switch. The body tube has first and second ends and a intermediate portion therebetween. The first end has a radial cross-section with an inner portion and an annular outer portion. The first make-up applying means has a first end thereof positioned in the inner portion of the body tube first end and a second end thereof extending axially outwardly. The first illuminating means is positioned in the annular outer portion of the first end, and is adapted to project the illumination axially outwardly. The means for powering the first illuminating means is mounted axially inwardly from the body tube first end in an interior of the body tube and communicated electrically to the first illuminating means. The switch selectively communicates the powering means to the first illuminating means.

In some aspects of the invention, the switch is positioned in the second end of the body tube.

In other embodiments of the invention, the second end of the applicator also has a cross-section with an inner portion and an annular outer portion, in which case that second end is provided with a second means for applying make-up. A first end of the second make-up applying means is positioned in the inner portion of the body tube second end. A second end of the second make-up applying means extends axially outwardly. A second illuminating means is provided, being positioned in the annular outer portion of the second end, and adapted to project the illumination axially outwardly. A means for powering the second illuminating means, positioned in an interior of the body tube and communicated electrically to the second illuminating means, is also provided, as is a switch for selectively communicating the powering means to the second illuminating means.

In some of these other embodiments, a single means for powering serves as the means for powering both the first illuminating means and the second illuminating means, the single powering means positioned in the interior of the body tube and communicated electrically to both of the respective illuminating means. In many of these embodiments, a single switch serves as the switch for electrically communicating both the first and the second illuminating means to the single means for powering. Such a single switch would be positioned on an external surface of the body tube intermediate portion.

In many aspects of the invention, the first illuminating means, and the second illuminating means, if present, comprises at least one light-emitting diode ("LED").

The first make-up applying means and the second make-up applying means, in embodiments where present, can be separately selected from the group consisting of a tube for containing a lipstick, a brush for applying mascara, a brush for applying lip gloss, lip liner or eye liner and pencil for applying eye liner.

In some aspects of the invention, the body tube first end has a circular cross-section. In other aspects, the body tube first end has an elliptical cross-section, while in yet other aspects, it may have a rectangular or a triangular cross-section.

In at least one embodiment, the at least one LED is directly mounted in the annular outer portion of the first end (and the second end, when present).

In another embodiment, the at least one LED is mounted in the interior of the body tube and is communicated by light communicating means to a light emitting means in the annular outer portion of the first end (and the second end, when present). In such a case, the light emitting means can be an annular ring of a transparent material.

BRIEF DESCRIPTION OF THE DRAWINGS

The present invention will be better understood when reference is made to the accompanying drawings, wherein identical parts are identified with identical reference numerals and wherein.

DETAILED DESCRIPTION OF A PREFERRED EMBODIMENT

Figure 1:
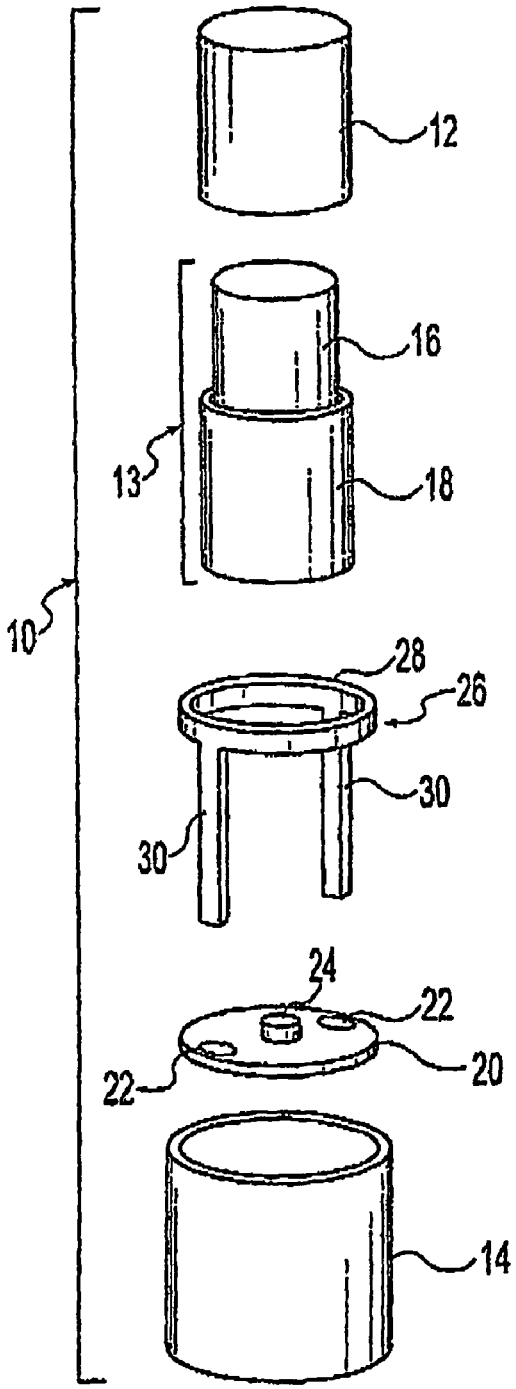
FIG. 1 shows an exploded view of a first embodiment of the present invention.
Figure 2:
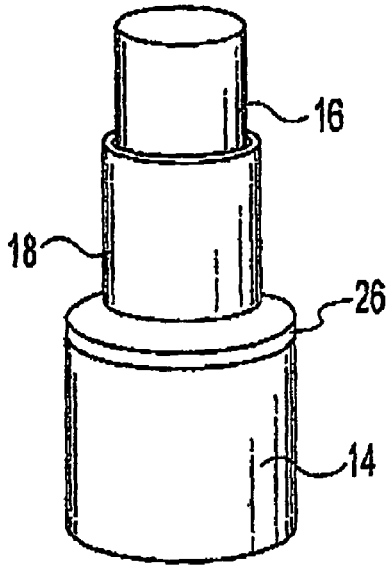
FIG. 2 shows an assembled view of the first embodiment.

Many of the features of the make-up applicator 10 of the present invention shown in FIGS. 1 and 2 (in respective exploded and assembled views) are well known and are not particularly different than the make-up applicator known in the prior art. For example, a lipstick cap 12 is provided for association with the first means 13 for applying make-up, in this particular case a lipstick mechanism with a sleeve 18 containing a lipstick makeup 16, which may be rotatably withdrawn into the lipstick sleeve when not in use. The lipstick sleeve 18 fits engagingly into a body tube 14 so that the lipstick sleeve extends axially outwardly from a first end of the body tube. In many embodiments, the lipstick cap 12 can be alternatively associated with the second end of the body tube 14 in a reverse direction during use.

The make-up applicator 10 of the present invention, however, has several features that are not disclosed or suggested by the prior art, which has taught the use of small incandescent lamps around the lipstick mechanism 13. The prior art has also taught the incorporation of a switch mechanism to provide selective lighting of the lamps. In contrast to this, the present invention provides the lighting in a different manner. Referring to FIG. 1, a circuit board 20 is shown that includes at least one light emitting diode ("LED") 22, a small battery 24 for powering the LED and appropriate electrical communication to selectively connect the battery to the LED. In the specific embodiment illustrated, in fact, two LEDs 22 are shown on the circuit board 20. The circuit board 20 is adapted to fit into the bottom of the body tube 14, that is, an interior portion of the body tube axially inwardly from the first end.

Surrounding the lipstick mechanism 13 in the body tube 14 is a lightpipe arrangement 26. This lightpipe arrangement 26 is characterized by a ring 28 of light-transmitting material with at least one leg member 30. The number of leg members 30 should correspond to the number of LEDs 22 used in the circuit board 20. Lightpipe arrangement 26 acts as an annular outer portion of the first end of body tube 14 and fits around the lipstick mechanism 13 to help secure it in the lipstick sleeve. The leg members 30 gather light from the LEDs and transmit the light to the ring, where it is emitted, preferably in a diffuse and uniform manner. In preferred embodiments, there may be some reflective material applied to non-emitting surfaces of the lightpipe arrangement in order to prevent light losses out of these non-emitting surfaces. Also, the index of refraction of the material may be selected to retain light in the lightpipe. For these reasons, the preferred material for the lightpipe mechanism 26 and the leg members 30 will be a clear, polymeric material.

While some of the prior art inventions provide relatively complex switching mechanisms for turning their light sources on and off, the use of an LED light source instead of an incandescent lamp in the present invention eliminates some of this complexity. The low power requirement of the LED compared to an incandescent lamp allows much longer battery life, so it is no longer critical that the light source be deactivated when not needed. In fact, a simple switching mechanism (not shown in FIGS. 1 and 2) that activates the LEDs 22 whenever the cap is removed from the sleeve or whenever the cap is engaged with the bottom end of the cap, just to provide a few examples, should be sufficient to protect battery life for at least the expected life of the lipstick itself, at which point the entire device is discarded. In many instances, a switch may be installed in the second end of the body tube 14 to switch the lighting mechanism on and off.

Figure 3A:
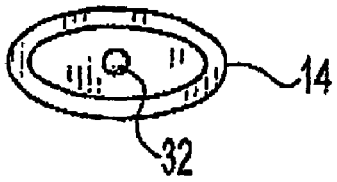
FIGS. 3*a* through 3*d* show a bottom view of the second end of the first embodiment applicator.
Figure 3B:
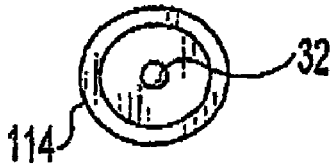
Figure 3C:
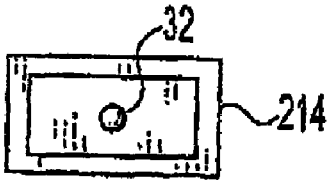
Figure 3D:
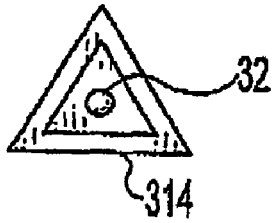

As is readily observed, the body tube 14 of FIG. 1 is elliptical in cross-section. A bottom view of four specific variations of the body tube, illustrating placement of a switch 32 in the second end of the elliptical body tube, is provided in FIG. 3*a*. Placement of an identical switch 32 in the bottom of a second type of body tube 114, having a circular cross section, is shown in FIG. 3*b*. A yet further use of a switch 32 in the second end of a body tube 214, having a rectangular cross-section, is shown in FIG. 3*c*. The use of a switch 32 in the second end of a body tube 314, having a triangular cross-section, is shown in FIG. 3*d*.

Figure 4A:
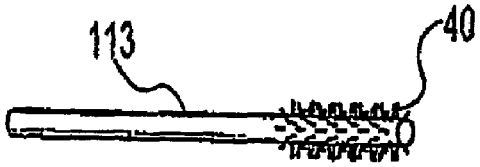
FIGS. 4*a* through 4*c* show side views of variations means for applying make-up.
Figure 4B:
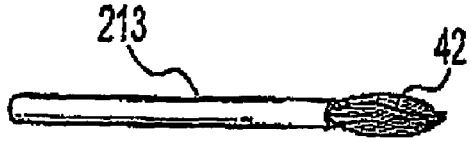
Figure 4C:
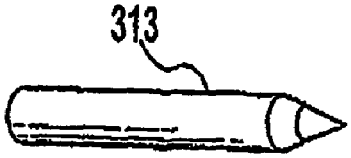

Just as the cross section of the body tube 14 may be varied in the particular embodiment of the invention, the type of means 13 for applying make-up may be varied from embodiment to embodiment. FIG. 1 shows a first means 13 that is exemplified by the lipstick mechanism. FIGS. 4*a-c* show, in isolated side views, two types of brushes 113, 213 and a pencil 313, any of which may serve as the means for applying make-up. The brush 113 in FIG. 4*a* has short, radially extending bristles 40, which are useful in applying a material such as mascara to the eye lashes. The brush 213 of FIG. 4*b* has longer, axially extending bristles 42, which can be used to apply lip gloss, lip liner, and eye liner, as a few examples. The pencil 313 in FIG. 4*c* can be used to apply eye liner. In each of these cases, the make-up application is achieved by a second end of the mechanism, and it may be necessary to enlarge the diameter of a first end of the mechanism, or to affix a base member, so that the make-up application device is engagingly received in the body tube.

Figure 5:
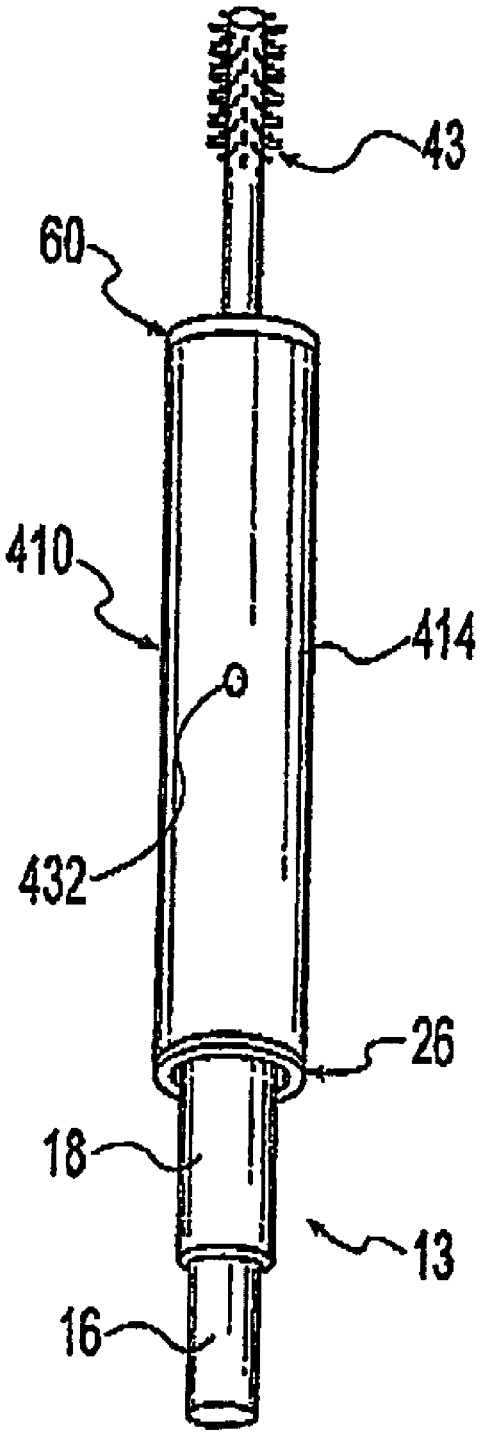
FIG. 5 shows an assembled side view of a second embodiment of the present invention.

Another embodiment 410 of the present invention device is shown in FIG. 5, in which the end caps, which would be typically provided, are not shown. In this embodiment 410, the first means 13 for applying make-up is a lipstick mechanism with a sleeve 18 containing a lipstick makeup 16, which may be rotatably withdrawn into the lipstick sleeve when not in use. The lipstick sleeve 18 fits engagingly into a first end of the body tube 414 so that the lipstick sleeve extends axially outwardly therefrom.

This second embodiment device 410 has several features that are not disclosed or suggested by the prior art. Particularly, the second embodiment 410 has a second end with a cross-section with an inner portion and an annular outer portion. This second end is provided with a second means 43 for applying make-up, a first end thereof positioned in the inner portion of the body tube second end and a second end thereof extending axially outwardly. In the particular example shown, the second end is provided with a second means 43 for applying make-up that is a mascara-type brush of the type shown in FIG. 4*a*.

This second embodiment 410 also has a second illuminating means 60 that is equivalent to the first illuminating means represented in FIG. 1 by the lightpipe arrangement 26. Internal details of the illuminating means 60 are not specifically disclosed, but it will be understood that they may be similar to any of the internal mechanisms disclosed in this application. It will be understood also that the switch 32 of the previous embodiment will not longer work, since the second end of the body tube is now occupied with a second make-up application means. Thus, the internal mechanisms in the body tube are centrally positioned, and the switch 432 will be preferably centrally located on an external surface of the intermediate portion of the body tube 414. This body tube 414 can be elliptical, circular, rectangular or triangular in cross section, just as the body tube 14 of the first embodiment 10 has already been demonstrated.

While it is possible to have separate means for powering the illuminating means and separate switches 432 on the exterior of the body tube 414, in most instances, the means for powering and the switch will be consolidated into a single powering means and switch, so that turning the illuminating means on effectively lights both ends of the body tube.

Figure 6:
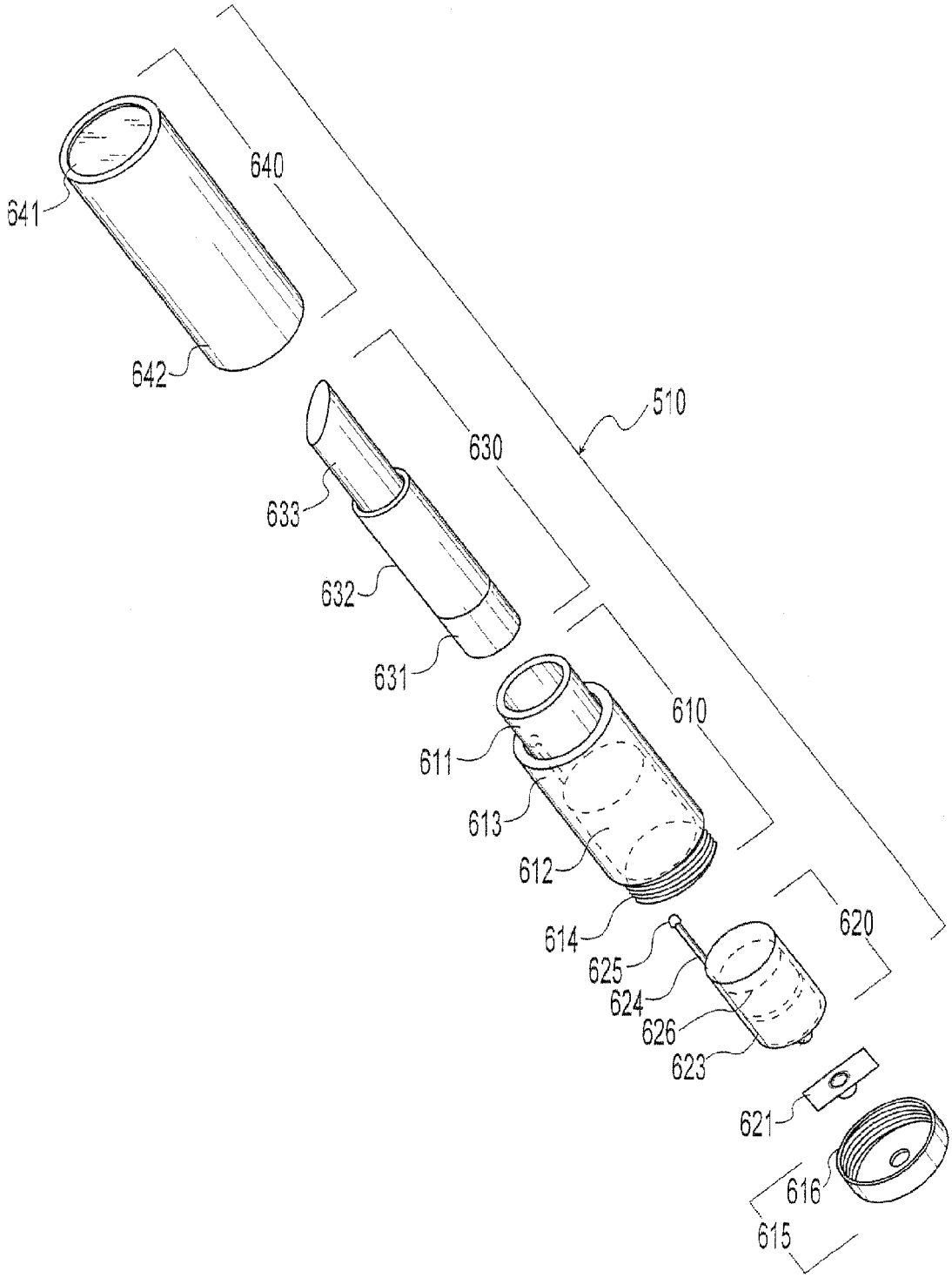
FIG. 6 shows an exploded view of a third embodiment of the present invention.
Figure 7:
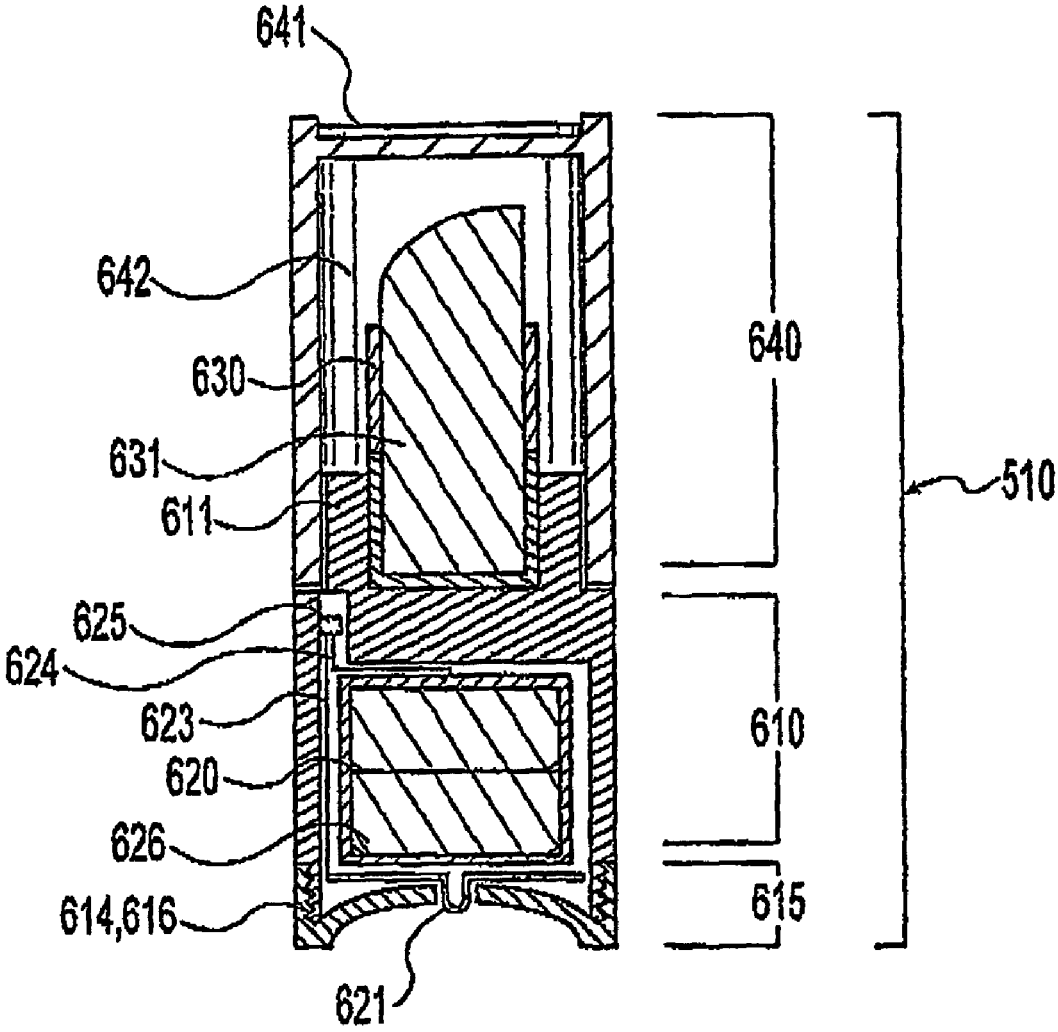
FIG. 7 shows an assembled side sectional view of the third embodiment.
Figure 8:
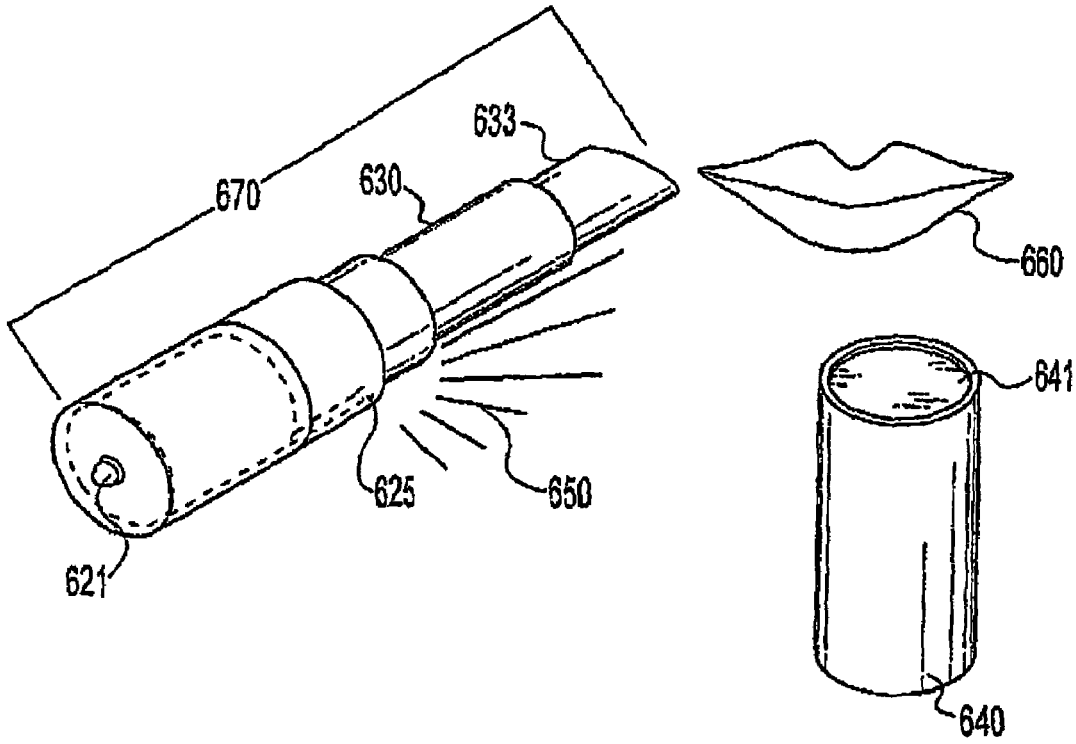
FIG. 8 shows the third embodiment of the invention in use.

Referring now to FIGS. 6 through 8, a third embodiment 510 of the invention is disclosed. In this embodiment, a luminous body receptacle base 610 with a luminous body receiving holder 612 is provided. This allows placement of the luminous body 620, the rear of which has a power source switch 621. The rear of the luminous body also has inner diameter threading 616 on the assembly box cap 615, to be combined with outer diameter threading 614 at the body of the luminous body receptacle base 610, thereby forming a unitary body. An LED 625, a negative electrode conducting plate 624 and a positive electrode conducting plate 623 are provided. There is also a battery 626, a lipstick assembly 630, a lipstick rotation ring 632 and a lipstick 633. The bottom 631 of the lipstick rotation ring 632 can be placed into the lipstick assembly receiving holder 611 at the upper end of the luminous body receptacle base, while the inner diameter 642 of the mirror surface 641 of the top end of the mirror-containing sleeve 640 can be slipped onto the outer diameter of the lipstick receiving holder to contain the lipstick assembly 630.

Further details of the third embodiment 510 are seen in assembled side view in FIG. 7.

Use of the third embodiment 670 is illustrated in FIG. 8. In such a use, the mirror-containing sleeve 640 is pulled off of the luminous body receptacle base 610. The luminous body receptacle base 610 is held in one hand of the user. By activating the power source switch 621, the LED 625 mounted near the lipstick assembly 630 is activated, thereby producing an axially extending illumination 650 for the lips 660 of the user. The mirrored surface 641 of the mirror-containing sleeve 640 may be held in the other hand of the user, thereby providing a mirror, if desired.

It will be readily understood that this third embodiment 510 places the LEDs directly at the first end of the body tube 614, rather than positioning them internally to the body tube. It will also be readily understood that the third embodiment shows the use of only one end of the body tube 614 for receiving make-up applying means, but that both ends of the body tube can be so provided if desired, in the manner described above.

Many variations within the scope of the appended claims will be apparent to those of skill in the art once the principles described herein are understood.

What is claimed is:

1. A device for applying make-up, useful in low-light situations, further comprising:

a body tube, having first and second ends and a intermediate portion therebetween, the first end having a radial cross-section with an inner portion and an annular outer portion, and the second end of the body tube having a cross-section with an inner portion and an annular outer portion;

a first make-up applicator, a first end thereof positioned in the inner portion of the body tube first end and a second end thereof extending axially outwardly;

a first lamp, positioned in the annular outer portion of the first end, and adapted to project illumination through a light-transmitting material and then axially outwardly;

a power source for powering the lamp, mounted axially inwardly from the body tube first end in an interior of the body tube and communicated electrically to the first lamp;

a switch for selectively communicating the power source to the first lamp;

a second make-up applicator, a first end thereof positioned in the inner portion of the body tube second end and a second end thereof extending axially outwardly;

a second lamp, positioned in the annular outer portion of the second end, and adapted to project the illumination axially outwardly;

a power source for powering the second illuminating means, positioned in an interior of the body tube and communicated electrically to the second lamp; and a switch for selectively communicating the power source to the second lamp.

2. The device of claim 1 wherein: the first and second lamps each comprise at least one light-emitting diode ("LED").

3. The device of claim 1, wherein:

the first make-up applicator is selected from the group consisting of a tube adapted for containing a lipstick, a brush adapted for applying mascara, a brush adapted for applying lip gloss, lip liner or eye liner and a pencil adapted for applying eye liner; and the second make-up applicator is separately selected from the group consisting of a tube adapted for containing a lipstick, a brush adapted for applying mascara, a brush for applying lip gloss, lip liner or eye liner and a pencil adapted for applying eye liner.

4. The device of claim 1, wherein:

the body tube first end has a circular cross-section.

5. The device of claim 1, wherein:

the body tube first end has an elliptical cross-section.

6. The device of claim 1, wherein:

the body tube first end has a rectangular cross-section.

7. The device of claim 1, wherein:

the body tube first end has a triangular cross-section.

8. The device of claim 1, wherein:

a single power source for powering serves as the power source for powering both the first lamp and the second lamp, the single power source positioned in the interior of the body tube and communicated electrically to both of the respective lamps.

9. The device of claim 8, wherein:

a single switch serves as the switch for electrically communicating both the first and the second lamps to the single power source.

10. The device of claim 9, wherein:

the switch is positioned on an external surface of the body tube intermediate portion.

11. The device of claim 2, wherein:

the at least one LED is positioned in the annular outer portion of the first end.

12. The device of claim 2, wherein:

the at least one LED is mounted in the interior of the body tube and light is communicated by the light-transmitting material to a light emitter in the annular outer portion of the first end.

13. The device of claim 12, wherein:

the light emitter is an annular ring of a transparent material.

14. The device of claim 8, wherein:

the at least one LED is mounted in the interior of the body tube and light is communicated by the light transmit ting material to a first light emitter in the annular outer portion of the first end and a second light emitter in the annular outer portion of the second end.

15. The device of claim 14, wherein:

the first and second light emitters are each an annular ring of a transparent material.

16. The device of claim 1, additionally comprising a cap, wherein the cap is adapted to associate with the body tube.

17. The device of claim 16, wherein the cap and switch are adapted to engage such that the switch is reversibly activated when the cap is removed from the body tube.

18. The device of claim 16, additionally comprising a mirror.

19. The device of claim 18, wherein the mirror is located on the cap.

* * * * *